US009526357B2

(12) United States Patent
Howard et al.

(10) Patent No.: US 9,526,357 B2
(45) Date of Patent: Dec. 27, 2016

(54) STORE FRAMES TOOTH PROFILES

(71) Applicant: HALLMARK CARDS, INCORPORATED, Kansas City, MO (US)

(72) Inventors: Richard Thomas Howard, Raymore, MO (US); Brian Lee Wegstein, Washburn, IL (US)

(73) Assignee: Hallmark Cards, Incorporated, Kansas City, MO (US)

( * ) Notice: Subject to any disclaimer, the term of this patent is extended or adjusted under 35 U.S.C. 154(b) by 0 days.

(21) Appl. No.: 14/338,049

(22) Filed: Jul. 22, 2014

(65) Prior Publication Data

US 2016/0007770 A1 Jan. 14, 2016

Related U.S. Application Data

(60) Provisional application No. 62/022,526, filed on Jul. 9, 2014.

(51) Int. Cl.

| | |
|---|---|
| ***A47B 96/06*** | (2006.01) |
| ***A47F 5/08*** | (2006.01) |
| ***A47B 57/42*** | (2006.01) |

(52) U.S. Cl.

CPC ..... *A47F 5/0807* (2013.01); *A47B 57/425* (2013.01); *A47B 96/061* (2013.01)

(58) Field of Classification Search

CPC ..... A47F 5/0807; A47F 5/0815; A47F 5/101; A47B 57/20; A47B 57/48; A47B 57/482; A47B 57/425; A47B 96/061; A47B 57/404; A47B 57/406; A47B 57/56

USPC ..... 248/220.31, 220.43

See application file for complete search history.

(56) References Cited

U.S. PATENT DOCUMENTS

| | | | | |
|---|---|---|---|---|
| 4,219,175 A * | 8/1980 | Harig | A47B 57/42 248/125.3 |
| 5,004,201 A * | 4/1991 | Bessinger | A47B 96/061 108/108 |
| 5,116,007 A * | 5/1992 | Von Gunton | A47B 57/42 108/108 |

* cited by examiner

*Primary Examiner* — Christopher E Garft

(74) *Attorney, Agent, or Firm* — Shook, Hardy & Bacon, L.L.P.

(57) ABSTRACT

A universal store frame bracket profile is provided for coupling to one of multiple different store frame openings. Embodiments of the bracket include a bracket body with a platform support surface, a first tooth feature, and a second tooth feature. The first and second tooth features extend in a first direction from an edge of the bracket body. In embodiments, the first tooth feature includes an upper and lower portion, while the second tooth feature includes a lower portion. A cavity formed between the first tooth feature and the bracket body, and the second tooth feature and the bracket body, provides a coupling mechanism for mating the universal bracket to one of multiple store frames.

19 Claims, 9 Drawing Sheets

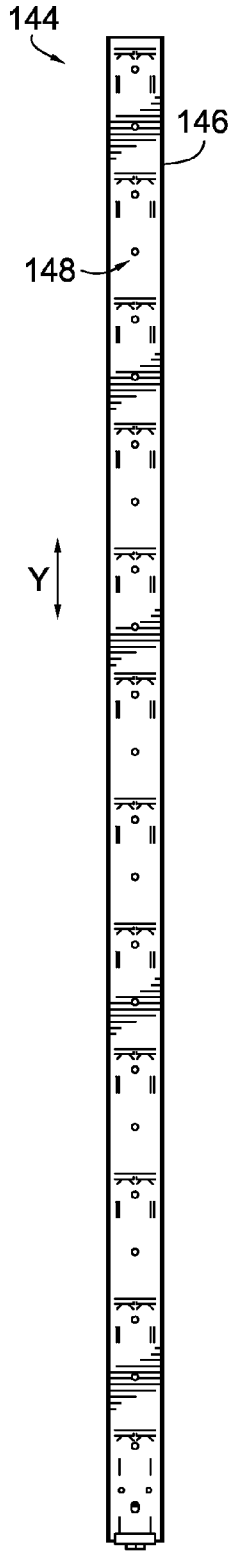
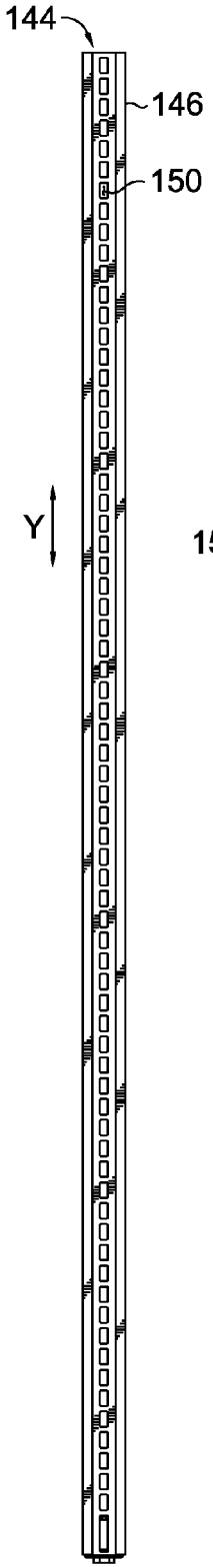
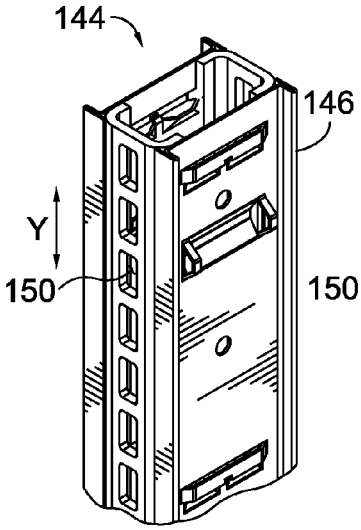
FIG. 14.
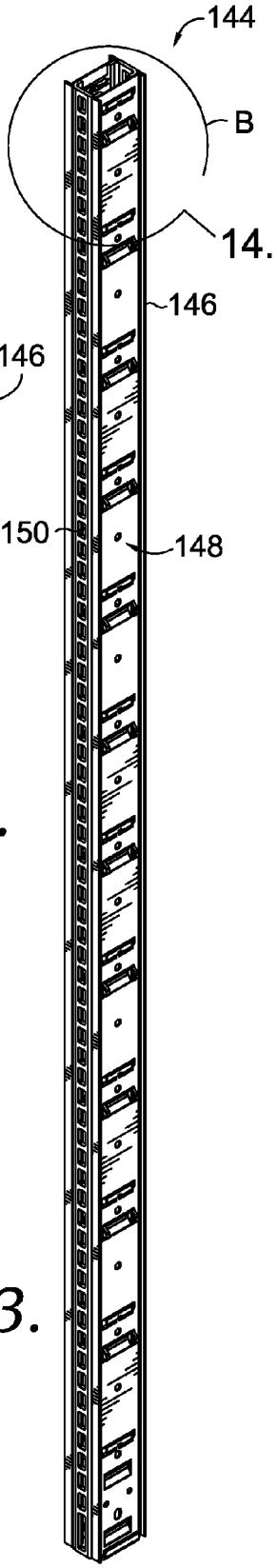
FIG. 13.
FIG. 11. FIG. 12.

STORE FRAMES TOOTH PROFILES

CROSS-REFERENCE TO RELATED APPLICATIONS

This application claims priority to U.S. Provisional Application Ser. No. 62/022,526, filed Jul. 9, 2014, entitled "Store Frames Tooth Profiles," the disclosure of which is hereby incorporated by reference in its entirety.

STATEMENT REGARDING FEDERALLY SPONSORED RESEARCH OR DEVELOPMENT

Not applicable.

TECHNICAL FIELD

The present invention relates generally to a retail display bracket and more specifically to a universal store frame bracket profile for coupling to a frame and securing shelving.

BACKGROUND

Retail display frame manufacturers typically require a frame-specific bracket having a profile designed to fit within the openings of their particular frame structure. With each manufacturer having different requirements for the frame structure, there are therefore different corresponding requirements for tooth patterns on brackets that fit into such frames.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Embodiments of the present invention are directed to a universal store frame bracket profile for coupling to a frame and securing shelving. In one embodiment, a store frame bracket profile includes a bracket body arranged in a first plane. Embodiments of the bracket body include 1) a platform support surface arranged in a second plane perpendicular to the first plane; 2) a first tooth feature arranged in the first plane, said first tooth feature extending in a first direction from the bracket body, wherein the first tooth feature comprises a first tooth feature upper portion, a first tooth feature lower portion, and a first tooth feature cavity; and 3) a second tooth feature arranged in the first plane, said second tooth feature spaced a first distance apart from the first tooth feature, said second tooth feature extending in the first direction from the bracket body, wherein the second tooth feature comprises a second tooth feature lower portion and a second tooth feature cavity, wherein the second tooth feature is below the first tooth feature when the first plane of the bracket body is in a vertical position.

In a further embodiment, a universal store frame bracket includes a bracket body having a first tooth feature having a first profile edge configured to couple to a first opening of a frame body, wherein the first tooth feature comprises a first tooth feature upper portion, a first tooth feature lower portion, and a first cavity; a second tooth feature having a second profile edge configured to couple to a second opening of a frame body, said second opening adjacent the first opening, wherein the second tooth feature comprises a second tooth feature lower portion and a second cavity.

In another illustrative embodiment, a store frame bracket profile includes a bracket body arranged in a first plane, wherein a perimeter of the bracket body comprises: (1) a front edge, wherein the front edge comprises a first tooth feature and a second tooth feature arranged in the first plane; (2) a rear edge opposite the front edge; (3) a top edge comprising a platform support surface in a second plane perpendicular to the first plane; and (4) a bottom edge.

BRIEF DESCRIPTION OF THE SEVERAL VIEWS OF THE DRAWINGS

The present invention is explained in more detail with reference to the embodiment illustrated in the attached drawing figures, in which like reference numerals denote like elements, in which FIGS. 1-30 illustrate two possible embodiments of the present invention, and in which:

FIG. 1 is a fragmentary side elevation view of an exemplary prior art store frame bracket profile;

FIG. 2 is a fragmentary side elevation view of a second exemplary prior art store frame bracket profile;

FIG. 3 is a fragmentary side elevation view of a third exemplary prior art store frame bracket profile;

FIG. 4 is a fragmentary side elevation view of a fourth exemplary prior art store frame bracket profile;

FIG. 5 is a fragmentary side elevation view of a fifth exemplary prior art store frame bracket profile;

FIG. 6 is a fragmentary side elevation view of a sixth exemplary prior art store frame bracket profile;

FIG. 7 is a front elevation view of an exemplary store frame for use in accordance with an embodiment of the present invention;

FIG. 8 is a side elevation view of the exemplary store frame of FIG. 7;

FIG. 9 is a perspective view of the exemplary store frame of FIG. 7;

FIG. 10 is an enlarged portion of the area 10 in the perspective view of FIG. 9;

FIG. 11 is a side elevation view of another exemplary store frame for use in accordance with an embodiment of the present invention;

FIG. 12 is a front elevation view of the exemplary store frame of FIG. 11;

FIG. 13 is a perspective view of the exemplary store frame of FIG. 11;

FIG. 14 is an enlarged portion of the area 14 in the perspective view of FIG. 13;

FIG. 15 is a front elevation view of yet another exemplary store frame for use in accordance with an embodiment of the present invention;

FIG. 16 is a side elevation view of the exemplary store frame of FIG. 15;

FIG. 17 is a perspective view of the exemplary store frame of FIG. 15;

FIG. 18 is an enlarged portion of the area 18 in the perspective view of FIG. 17;

FIG. 19 is a side elevation view of still another exemplary store frame for use in accordance with an embodiment of the present invention;

FIG. 20 is a front elevation view of the exemplary store frame of FIG. 19;

FIG. 21 is a perspective view of the exemplary store frame of FIG. 19;

FIG. 22 is an enlarged portion of the area 22 in the perspective view of FIG. 21;

FIG. 23 is a perspective view of a store frame bracket profile, in accordance with an embodiment of the invention;

FIG. 24 is a top plan view of the store frame bracket profile of FIG. 23;

FIG. 25 is an enlarged fragmentary side elevation view of a portion of the store frame bracket profile of FIG. 23;

FIG. 26 is a side elevation view of the store frame bracket profile of FIG. 23;

FIG. 27 is a perspective view of a pair of adaptors having the bracket profile in accordance with an embodiment of the invention for coupling to a store frame;

FIG. 28 is a front elevation view of one of the adaptors of FIG. 27;

FIG. 29 is a side elevation view of the adaptor of FIG. 28; and

FIG. 30 is a cross-sectional top plan view of the adaptor of FIG. 28 taken along the line 30-30 in FIG. 29.

DETAILED DESCRIPTION

Figure 1:
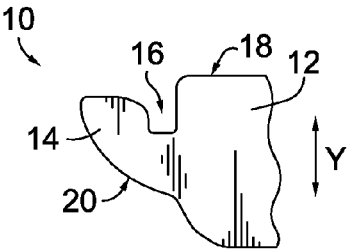
FIG. 1. PRIOR ART

Referring now to the drawings in more detail, wherein like reference characters designate like parts throughout the different views, and initially to FIG. 1, numeral 10 generally designates an example of a prior art bracket. The bracket 10 has a bracket body 12, a tooth feature 14, a cavity 16, a platform support surface 18, and a curved profile 20. In embodiments, the bracket 10 may be coupled to a particular store frame configured to mate to the profile of tooth feature 14, and in particular to engage with at least a portion of cavity 16 while stabilizing the platform support surface 18.

Figure 2:
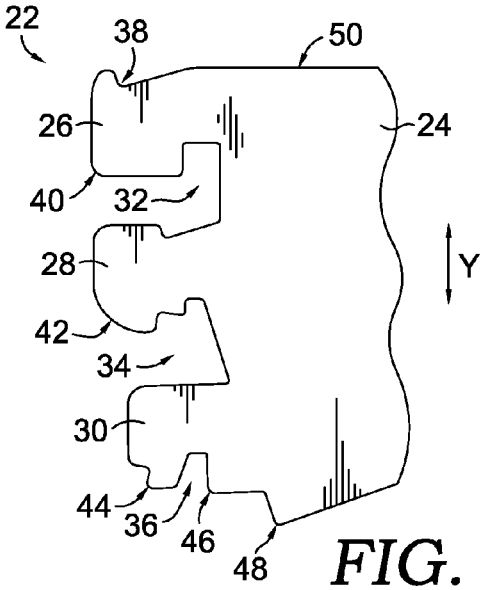
FIG. 2. PRIOR ART

Similarly, as shown in the prior art bracket 22 of FIG. 2, a bracket body 24 may include a different profile, such as including a first tooth feature 26, a second tooth feature 28, and a third tooth feature 30 along a profile edge of the bracket 22. In embodiments, in order to mate a first cavity 32, a second cavity 34, and a third cavity 36 to a series of three consecutive openings on a particular store frame structure, a top curved profile 38 and teeth curved profiles 42-48 may be engaged against a particular feature on a particular store frame for which the bracket body 24 was designed.

Figure 3:
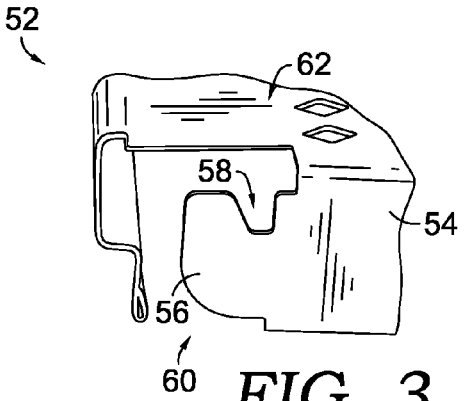
FIG. 3. PRIOR ART

In FIG. 3, a different configuration of prior art bracket 52 is provided, having a bracket body 54, a tooth feature 56, a cavity 58, a curved profile 60, and a platform support surface 62. As discussed above, based on an interaction between the curvature of the cavity 58 and a curved profile 60 of the tooth feature 56, the prior art bracket 52 may interact with a particular opening on a particular store frame configured to receive brackets having the orientation and/or configuration matching that of the prior art bracket 52.

Figure 4:
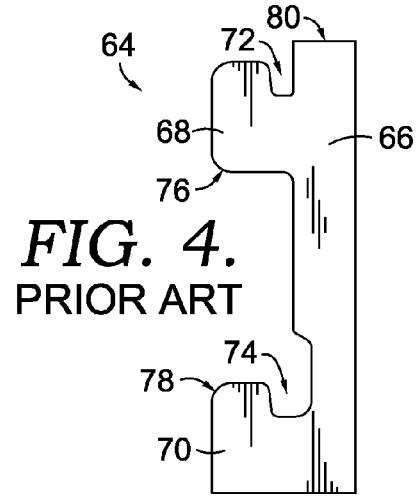
FIG. 4. PRIOR ART

As shown in FIG. 4, a further example of a prior art bracket includes prior art bracket 64, with a bracket body 66, a first tooth feature 68, a second tooth feature 70, a first cavity 72, a second cavity 74, curved profiles 76, 78, and a platform support surface 80. Based on interaction of the first cavity 72 and the second cavity 74 with an internal feature on an opening of a store frame, the platform support surface 80 may be used to support force applied to the top surface of the bracket 64, such as a force applied to platform support surface 80. Further, prior to application of such force to the supportive bracket 64, the bracket may be mated to a particular series of openings on a store frame, such as those designed to correspond to the position, shape and/or orientation of the first tooth feature 68 and the second tooth feature 70. As such, based on curved profiles 76 and 78 of each tooth feature, the prior art bracket 64 may lock into place with respect to a particular store frame design.

Figure 5:
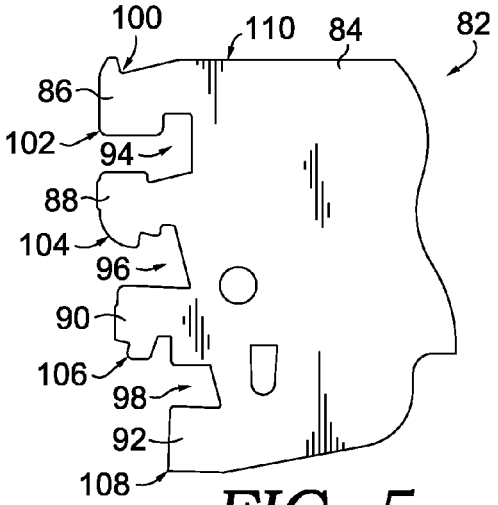
FIG. 5. PRIOR ART

In FIG. 5, another exemplary prior art bracket 82 includes a bracket body 84, with a series of first, second, third, and fourth tooth features 86, 88, 90, 92 along a front edge of the bracket body 84. As configured, one or more portions of curved profiles 100, 102, 104, 106 may be used to manipulate and/or position the tooth features 86, 88, 90, 92 of bracket 82 into a particular series and/or configuration of openings along a store frame structure. As such, with a straight edge profile 108 resting against a portion of a store frame, the platform support surface 110 may be used to support a force, such as a shelf resting upon the bracket body 84.

Figure 6:
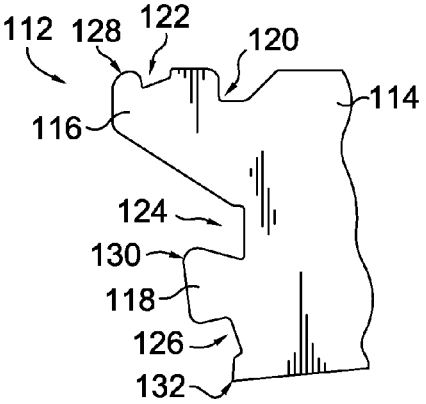
FIG. 6. PRIOR ART
Figure 7:
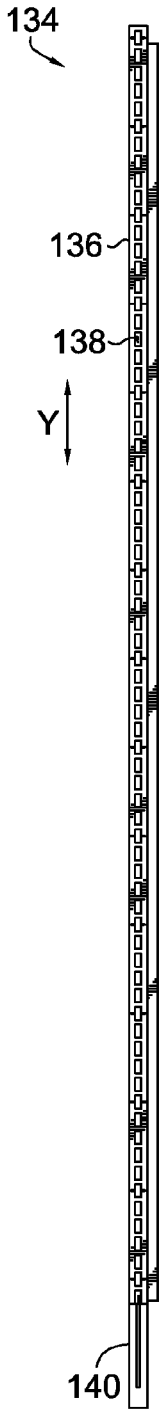
Figure 8:
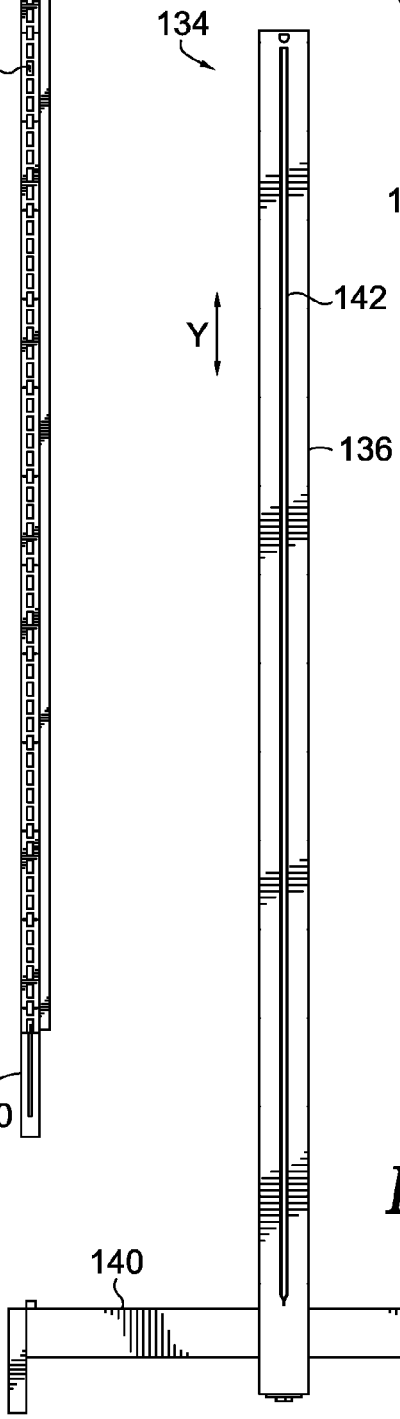

In yet another example, the profile of prior art bracket 112 in FIG. 6 includes a bracket body 114 having first and second tooth features 116 and 118, first, second, third, and fourth cavities 120, 122, 124, 126, curved profiles 128 and 130, and an angled profile 132, all of which are configured to coordinate with and/or correspond to a particular feature on an opening of a store frame. As shown, the exemplary prior art bracket 112 includes an outer edge configured to couple to a particular store frame having a corresponding orientation of openings.

Figure 10:
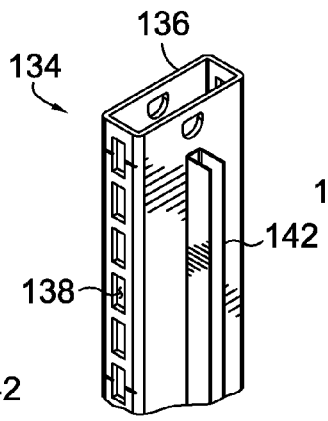
Figure 9:
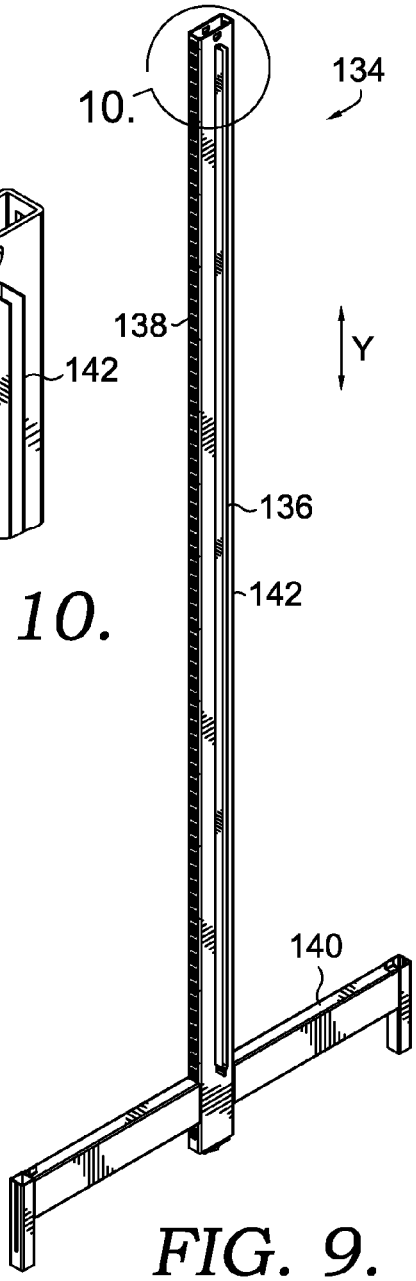
Figure 16:
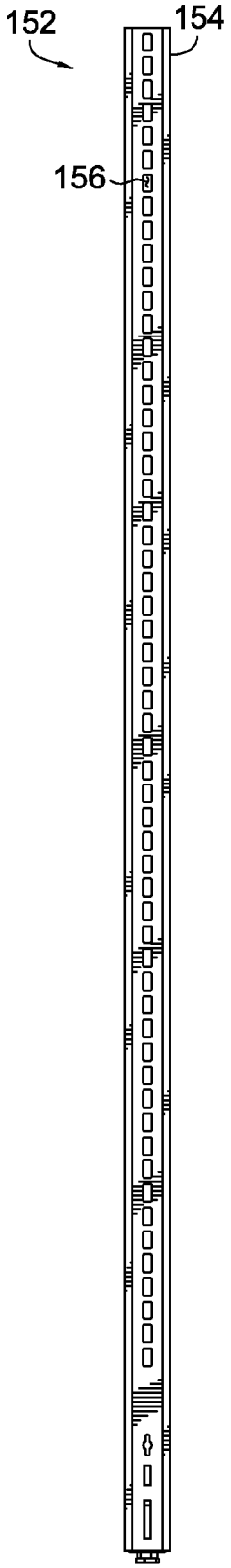
Figure 15:
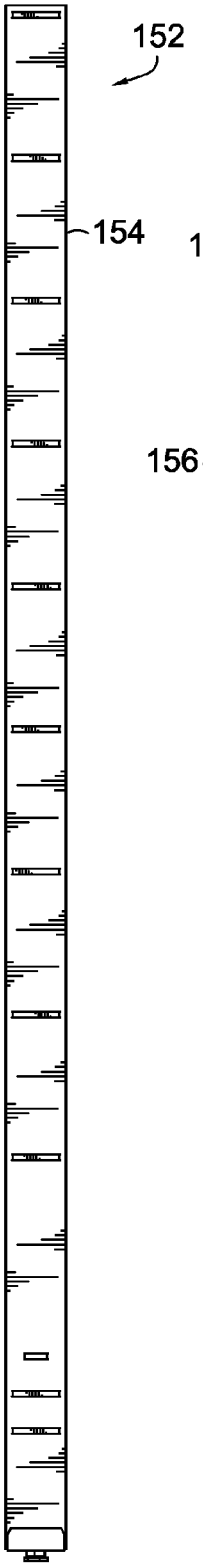

Turning now to FIGS. 7-10, an exemplary store frame 134 is provided, for coupling with a particular bracket profile. In embodiments, the store frame 134 includes a frame body 136 with openings 138, a stand 140, and a channel feature 142. In embodiments of the invention, a universal bracket profile is provided, for coupling to the openings 138 of the store frame 134. FIG. 10 discloses, in an enlarged portion, an interior profile of openings 138, for coupling with a bracket profile, and in particular, a bracket profile with corresponding, spaced teeth.

Figure 18:
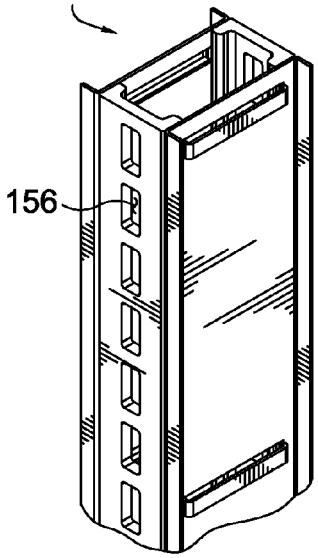
Figure 17:
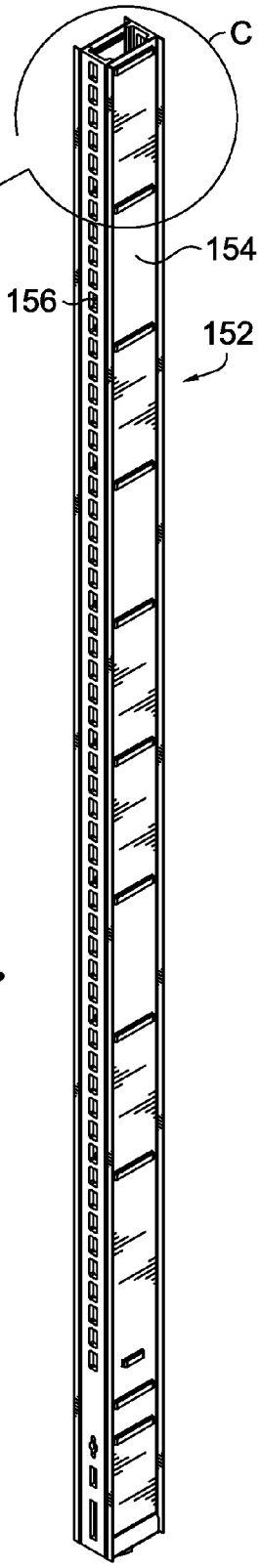
Figure 19:
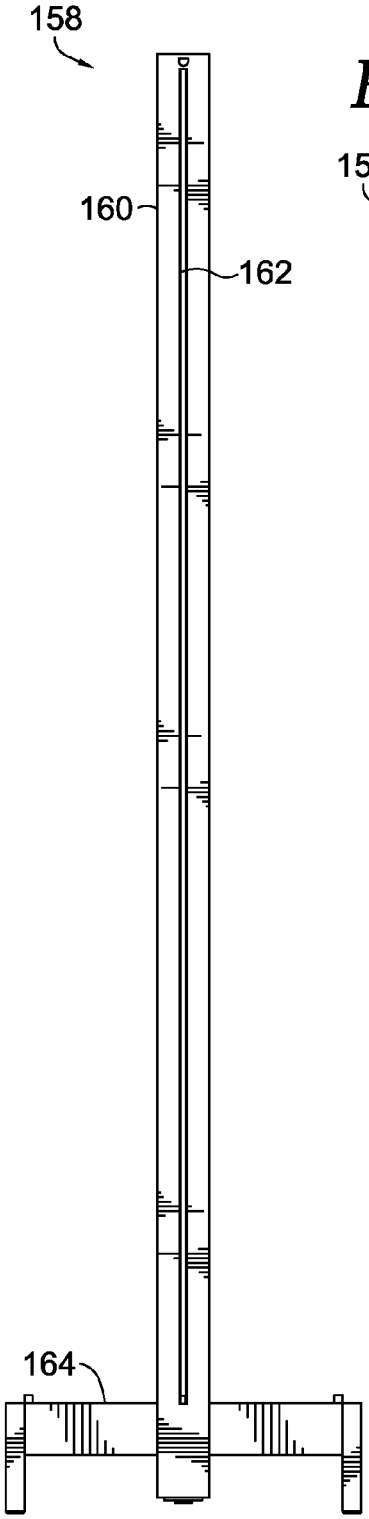
Figure 20:
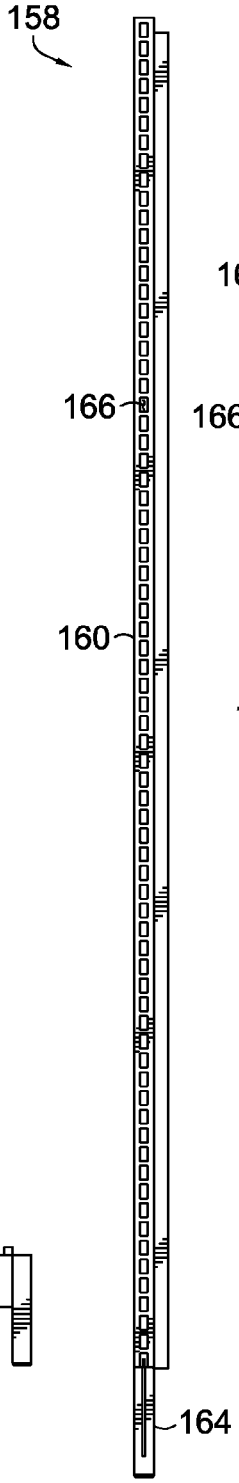
Figure 22:
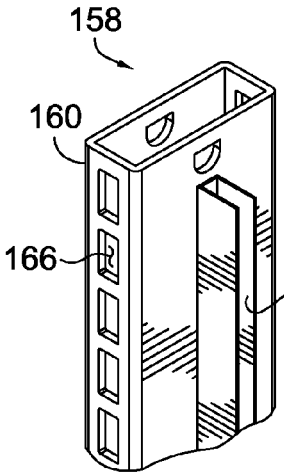
Figure 21:
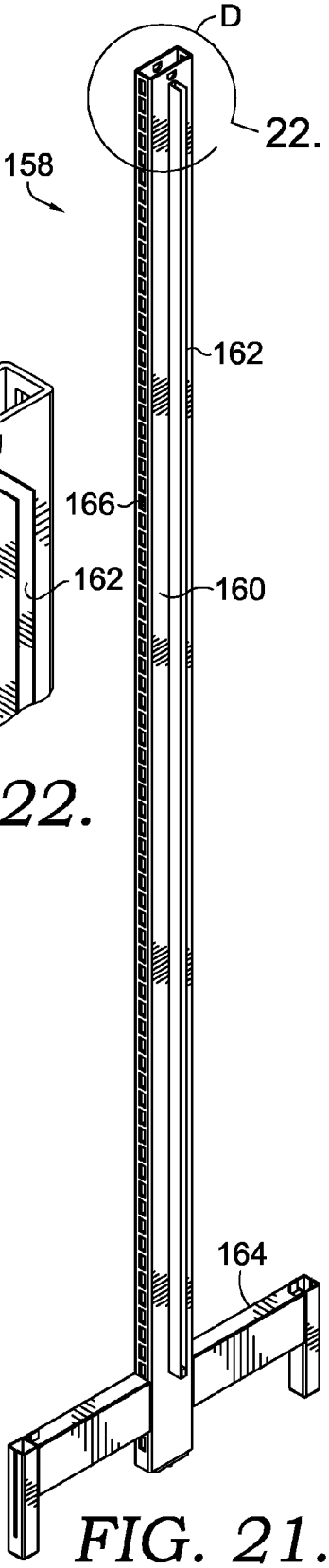

Similarly, in FIGS. 11-14, another exemplary store frame 144 is provided, having a frame body 146, an outer surface 148, and a series of openings 150. In embodiments of the invention, although the openings 150, shown in enlarged FIG. 18, are configured to accept a particular orientation of teeth profiles, a universal bracket profile may be provided to coordinate and/or interact with both the openings 150 of frame body 146, as well as the openings 138 of frame body 136.

With reference to FIGS. 15-18, a further example of a store frame for coupling with a universal bracket profile is provided. In FIGS. 15-18, an exemplary store frame 152 includes a frame body 154 having a series of adjacent openings 156. As discussed with respect to the additional store frame examples, the series of adjacent openings 156 are configured to couple to a particular orientation of tooth profiles on a bracket, as shown in enlarged FIG. 18.

Similarly, an exemplary store frame 158 in FIGS. 19-22 provides yet another configuration for supporting one or more brackets having particular teeth profiles on an edge of the bracket. In the example of FIGS. 19-22, the store frame 158 includes a frame body 160 having a channel feature 162, a stand 164, and a series of openings 166 that, as shown in enlarged FIG. 22, may interact and/or interlock with a portion of a bracket profile configured specifically to interact with openings 166. In embodiments of the invention, although openings 166 are configured to couple to a particular bracket profile (and openings 138, 150, and 156 are similarly oriented for coupling to a particular bracket profile), a universal bracket may be provided for coupling to each store frame, as shown in the embodiment of FIGS. 23-26 below.

Figure 23:
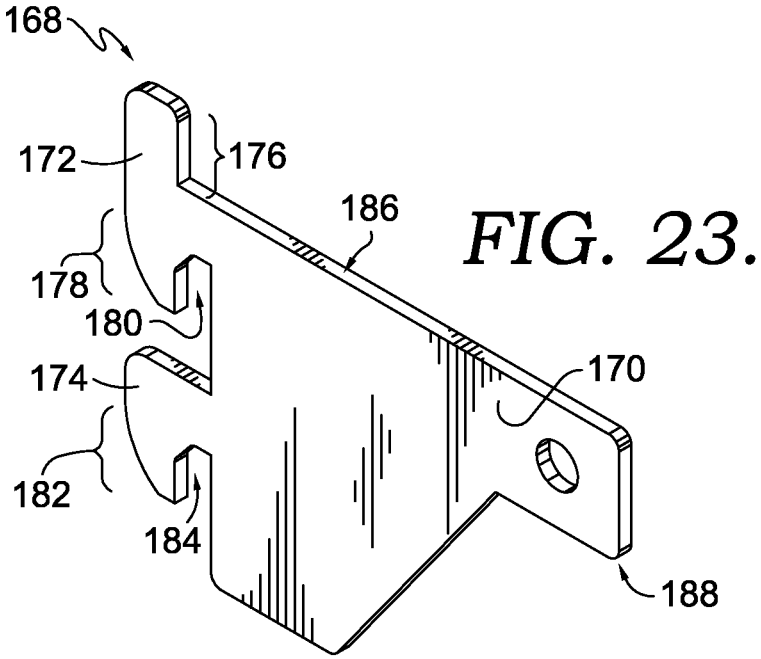
Figure 24:
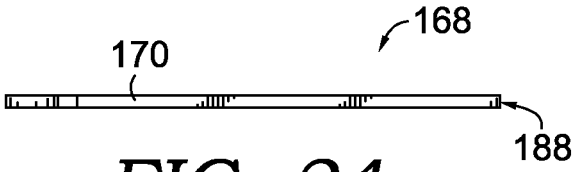

With reference initially to FIG. 23, an exemplary universal store frame bracket 168 is provided. The bracket 168 includes a bracket body 170 having a first tooth feature 172 and a second tooth feature 174 oriented along a front edge of the bracket body 170. In embodiments, the first tooth feature 172 includes an upper portion 176, a lower portion 178, and a first cavity 180 between the lower portion 178 of the first tooth feature 172 and the remainder of the bracket body 170.

As further shown in the embodiment of FIG. 23, the second tooth feature 174 includes a lower portion 182 extending below the second tooth feature 174, with a second cavity 184 between the lower portion 182 of the second tooth feature 174 and the remainder of the bracket body 170. In embodiments of the invention, as discussed above with respect to the exemplary store frames of FIGS. 11-22, the universal store frame bracket 168 may be configured to couple to multiple different configurations of openings on multiple different store frames.

With continued reference to the perspective view of FIG. 23, embodiments of bracket 168 include a platform support surface 186 by virtue of a thickness of a frame body 188. As further shown in FIG. 24, the thickness of the bracket body 170 may provide a universal support structure used as a bracket in one or more different store frame embodiments. As such, in some embodiments of the invention, one or more brackets 168 may be coupled to one or more store frames for supporting a store shelf along adjacent platform support surfaces 186.

Figure 25:
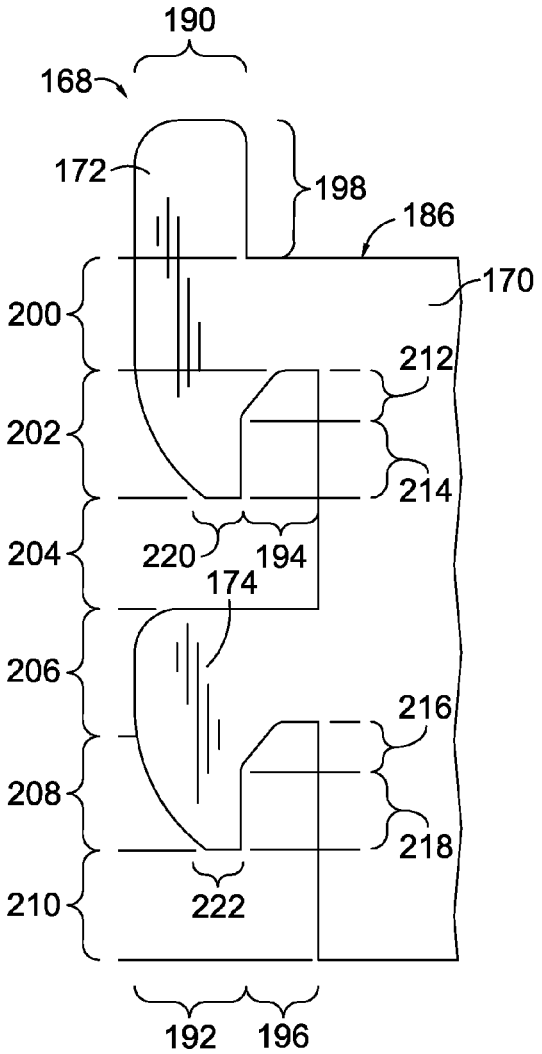

Turning now to FIG. 25, the particular dimensions of the bracket 168 are discussed. In one embodiment of the invention, the bracket body 170 includes the first tooth feature 172 having a first depth 190, and the second tooth feature 174 having a second depth 192. In one embodiment of the invention, the first depth 190 is the same dimension as the second depth 192. As further shown in FIG. 25, the first tooth feature 172 is space apart from or extends a first distance 194 from the bracket body 170, while the second tooth feature 174 extends a second distance 196 from the from the bracket body 170. In some embodiments of the invention, the first distance 194 is the same distance as the second distance 196.

As further depicted in the example of FIG. 25, first tooth feature 172 extends a third distance 198 above the platform support surface 186 of bracket body 170. Additionally, as shown along the front edge profile of the bracket body 170, the spacing of a fourth distance 200, a fifth distance 202, a sixth distance 204, a seventh distance 206, an eighth distance 208, and a ninth distance 210 correspond to each segment of the frame body 170. In the example of FIG. 25, the frame body 170 further includes a tenth distance 212, an eleventh distance 214, a twelfth distance 216, and a thirteenth distance 218. Such various distances correspond to various portions of the first and second tooth features 172 and 174, as described with reference to FIGS. 25 and 26. Further, based on the distances described in more detail below, each tooth feature tapers to a particular configuration for mating with one of multiple different store frames, using a lower tip portion 220 of the first tooth feature 172, and a lower tip portion 222 of the second tooth feature 174.

Figure 26:
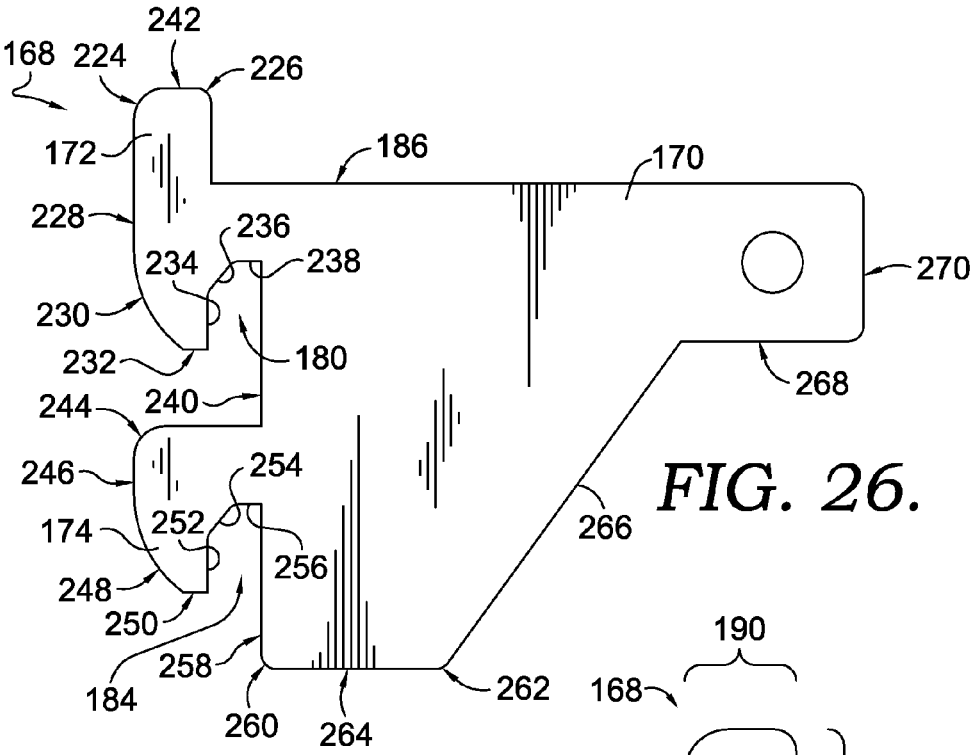

Turning finally to FIG. 26, the various depths and distances described with respect to FIG. 25 may be used to define one or more portions of the bracket body 170 in the exemplary universal bracket 168. In FIG. 26, an embodiment of the bracket body 170 includes a first upper edge 224 and a second upper edge 226 on the upper portion 176 of the first tooth feature 172. In embodiments, first tooth feature 172 further includes a lead edge 228, a curved profile 230, a tip surface 232, a rise portion 234, an angled portion 236, and a stop portion 238. In some embodiments of the invention, the lower portion 178 of the first tooth feature 172 is inserted into an opening of a store frame, for coupling an edge of the opening to the cavity 180. In another embodiment, bracket 168 may be coupled to an exemplary store frame by first inserting the top edge 242 and/or upper portion 176 of the first tooth feature 172 into an opening of a store frame, followed by orienting the lower portions 178 and 182 within the corresponding openings. In some embodiments of the invention, a separation segment 240 defines a particular distance between the first tooth feature 172 and the second tooth feature 174. As such, a universal bracket 168 is configured to have a particular orientation of the first tooth feature 172 with respect to the second tooth feature 174, based on the dimension of the separation segment 240.

Embodiments of the frame body 170 further include an upper edge 244, a lead edge 246, a curved profile 248, a tip surface 250, a rise portion 252, an angled portion 254, and a stop portion 256 of the second tooth feature 174. In some embodiments of the invention, a separation segment 258 may define a particular distance between the stop portion 256 and a bottom surface 264 of the bracket body 170. As further depicted in FIG. 26, the bottom surface 264 may include a first bottom edge 260 and a second bottom edge 262 for orienting at least a portion of the bracket body 170 with respect to a frame body of a store frame. As such, the bottom surface of the bracket body 170 may also include a slanted surface 266, a bottom edge 268, and a front edge 270 that provide a universal profile for extending from the surface of a store frame coupled to the universal bracket 168.

In embodiments of the invention, based on orientation and/or shape of one or more features and/or portions of the bracket 168, a universal bracket structure is provided for use with multiple different store frames. As such, openings on a store frame may have multiple different orientations, but may all still be configured to interact with the single, universal bracket 168. In some embodiments of the invention, two consecutive openings on a store frame may couple to the first tooth feature 172 and the second tooth feature 174 of the bracket 168 based on an edge of each opening abutting the stop portions 238 and 256 within the first cavity 180 and second cavity 184 respectively. In some embodiments of the invention, the curved profile 230, curved profile 248, angled portion 236, and/or angled portion 254 may correspond to and/or interact with various portions of the openings of various store frames to provide a universal bracket 168 configured to couple to each different store frame structure.

It should be noted that the bracket body 170 and frame body 188 of the bracket 168 can be of any configuration and shape, including standard configurations and shapes, and still derive the benefit of the universal tooth pattern and profile provided by the first tooth feature 172 and the second tooth feature 174. For example, instead of the tooth pattern being employed on the bracket 168 illustrated in FIGS. 23-26, the tooth pattern may be employed on a rear of longer brackets or even shelves.

Figure 27:
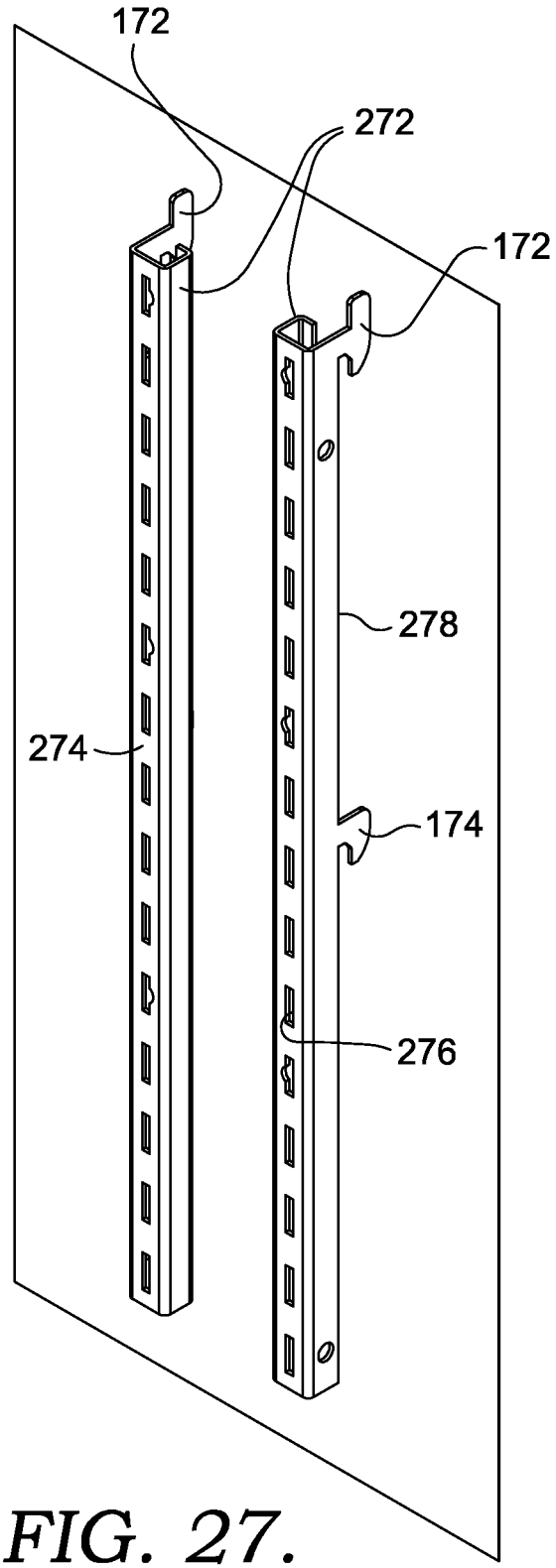
Figure 28:
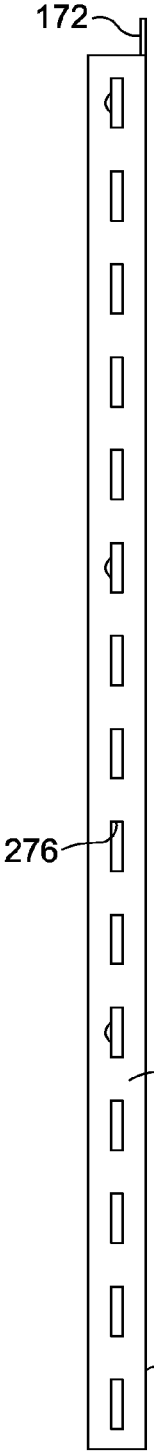
Figure 30:
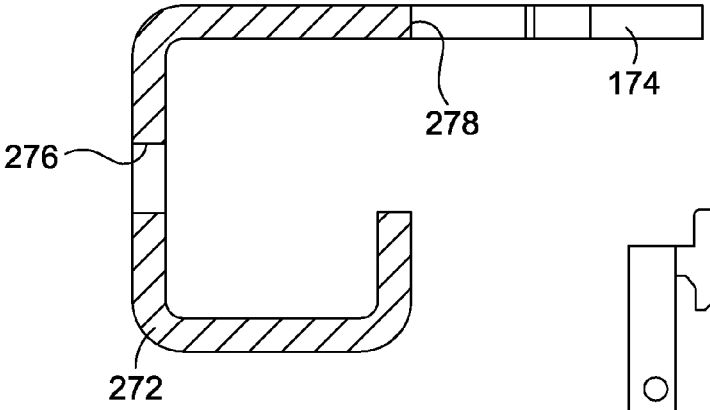
Figure 29:
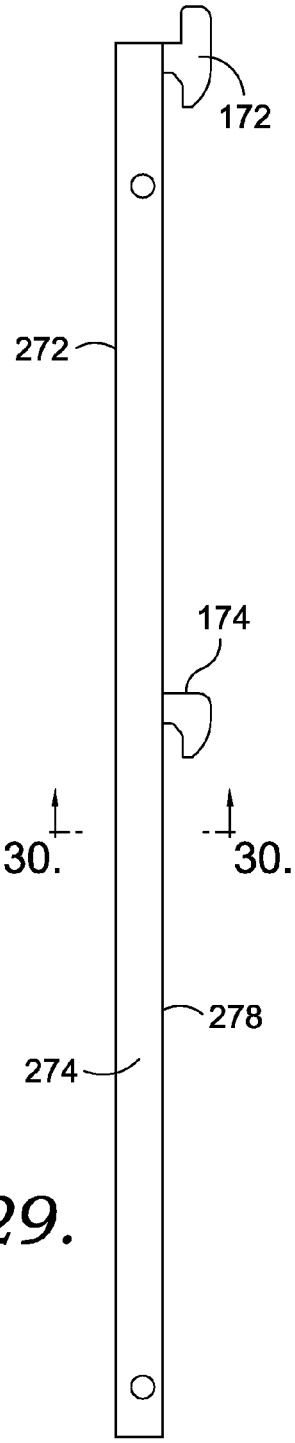

Further, while the tooth pattern of the present invention can be employed on brackets to allow them to couple with a wide variety of store frames, the tooth pattern can be employed on something other than a bracket and still be useful. For example, FIGS. 27-30 illustrate an adaptor 272 that employs the universal tooth pattern of the present invention. Specifically, FIG. 27 illustrates a pair of adaptors 272 that are mirror images of each other. Each adaptor 272 includes a body portion 274 that takes the shape of a shelf standard having a plurality of openings 276 spaced there along. The universal tooth pattern provided by the first tooth feature 172 and the second tooth feature 174 is provided by extending the first tooth feature 172 and the second tooth feature 174 from a rear edge 278 of each body portion 274. In this embodiment, the first and second tooth features 172, 174 are spaced apart from each other a greater distance than the separation segment 240 of the bracket 168. The distance between the tooth features 172, 174 can be based on multiples of a standard distance between openings in store frames (e.g., one inch). Accordingly, the adaptors 272 can couple to the same store frames as the bracket 168.

The adaptors are beneficial as the hole pattern or spacing between openings 276 may be of a pattern different from the hole pattern of the store frame to which the adaptors 272 are coupled. This would allow a user to couple their standard components (e.g., brackets, shelves, etc.), having a first tooth pattern, to store frames having a hole pattern designed for a second tooth pattern and which otherwise would not accept the first tooth pattern. In this manner, a user may couple their standard components to store frames of multiple different manufacturers and hole patterns. This prevents the user from having to purchase components for each different store frame by using adaptors 272 with hole patterns specific to work with the tooth patterns of their components. This is possible by the adaptors having the universal tooth pattern and profile provided by the first tooth feature 172 and the second tooth feature 174 which allows the adaptors 272 to couple with multiple different store frames.

Many variations can be made to the illustrated embodiment of the present invention without departing from the scope of the present invention. Such modifications are within the scope of the present invention. For example, the orientation and/or proportion of the first and second teeth features may be different from those illustrated. For example, the upper or lower portions of the first tooth profile may be a different depth and/or distance, while still providing a universal configuration for coupling to multiple store frames. Similarly, the lower portion of the second tooth feature may have features that vary in orientation and/or proportion from the first tooth feature, but still provide a universal function for interaction with a store frame, in coordination with the first tooth feature.

From the foregoing it will be seen that this invention is one well adapted to attain all ends and objects hereinabove set forth together with the other advantages which are clear following the complete disclosure above and which are inherent to the methods and apparatuses described herein. It will be understood that certain features and subcombinations are of utility and may be employed without reference to other features and subcombinations. This is contemplated by and is within the scope of the invention and claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

The invention claimed is:

1. A store frame bracket profile comprising:

a bracket body arranged in a first plane, said bracket body having a bracket body front edge, wherein the bracket body comprises:

a platform support surface arranged in a second plane perpendicular to the first plane;

a first tooth feature arranged in the first plane, said first tooth feature extending in a first direction from the front edge of the bracket body, wherein the first tooth feature comprises a first tooth feature upper portion, a first tooth feature lower portion, and a first tooth feature cavity, wherein the first tooth feature cavity comprises:

a rise portion on the first tooth feature lower portion adjacent a bottom tip surface of the first tooth feature, said rise portion parallel to the front edge of the bracket body;

a stop portion adjacent the front edge of the bracket body; and an angled portion between the rise portion and the stop portion, said angled portion above the rise portion and diagonal to the front edge of the bracket body; and a second tooth feature arranged in the first plane, said second tooth feature spaced a first distance apart from the first tooth feature, said second tooth feature extending in the first direction from the bracket body, wherein the second tooth feature comprises a second tooth feature lower portion and a second tooth feature cavity, wherein the second tooth feature is below the first tooth feature when the first plane of the bracket body is in a vertical position, said store frame bracket profile configured to removably couple to a plurality of store frames having at least two openings, said at least two openings spaced apart a second distance corresponding to the first distance.

2. The store frame bracket profile of claim 1, wherein the bracket body comprises a metal bracket body configured to support an amount of force applied to the platform support surface.

3. The store frame bracket profile of claim 1, wherein the first tooth feature upper portion extends a second distance above the platform support surface.

4. The store frame bracket profile of claim 1, wherein the first tooth feature lower portion extends a third distance below the platform support surface.

5. The store frame bracket profile of claim 1, wherein the first tooth feature cavity is adjacent the first tooth feature lower portion.

6. The store frame bracket profile of claim 1, wherein the first tooth feature lower portion comprises a curved edge profile on at least a portion of an outer edge of the first tooth feature lower portion.

7. The store frame bracket profile of claim 6, wherein the first tooth feature lower portion comprises a straight tip profile on at least a portion of an outer edge of the first tooth feature lower portion, said straight tip profile adjacent the curved edge profile.

8. The store frame bracket profile of claim 1, wherein the second tooth feature lower portion comprises a curved profile on at least a portion of an outer edge of the second tooth feature lower portion.

9. The store frame bracket profile of claim 1, wherein the second tooth feature cavity comprises:

a rise portion on the second tooth feature lower portion adjacent a bottom tip surface of the second tooth feature;

a stop portion adjacent the bracket body; and an angled portion between the rise portion and the stop portion, said angled portion above the rise portion.

10. A universal store frame bracket comprising:

a bracket body comprising:

a first tooth feature along a front edge of the bracket body, said first tooth feature having a first profile edge configured to couple to a first opening of a first frame body, wherein the first tooth feature comprises a first tooth feature upper portion, a first tooth feature lower portion, and a first cavity, wherein the first cavity comprises:

a rise portion on the first tooth feature lower portion adjacent a bottom tip surface of the first tooth feature;

a stop portion adjacent the front edge of the bracket body; and an angled portion between the rise portion and the stop portion, said angled portion above said rise portion and diagonal to the front edge of the bracket body; and a second tooth feature along the front edge of the bracket body, said second tooth feature having a second profile edge configured to couple to a second opening of the first frame body, said second opening below the first opening and separated a distance from the first opening corresponding to a separation distance between the first tooth feature and the second tooth feature with respect to the front edge of the bracket body, wherein the second tooth feature comprises a second tooth feature lower portion and a second cavity.

11. The universal store frame bracket of claim 10, wherein the first tooth feature lower portion comprises:

a curved edge profile on a front edge of the first tooth feature lower portion; and a straight tip on a bottom edge of the first tooth feature lower portion.

12. The universal store frame bracket of claim 10, wherein at least a portion of one or more of the rise portion, the angled portion, and the stop portion is configured to removably mate to the first opening.

13. The universal store frame bracket of claim 10, wherein the first tooth feature upper portion comprises a first upper edge and a second upper edge, wherein at least one of the first upper edge and the second upper edge is configured to engage at least a portion of the first opening.

14. The universal store frame bracket of claim 10, wherein the second tooth feature lower portion comprises:

a curved edge profile on a front edge of the second tooth feature lower portion; and a straight tip on a bottom edge of the second tooth feature lower portion.

15. The universal store frame bracket of claim 10, wherein the second cavity comprises:

a rise portion on the first tooth feature lower portion adjacent a bottom tip surface of the first tooth feature;

a stop portion adjacent the front edge of the bracket body; and an angled portion between the rise portion and the stop portion, said angled portion above said rise portion and diagonal to the front edge of the bracket body, wherein at least a portion of one or more of the rise portion, the angled portion, and the stop portion is configured to mate to the second opening.

16. A store frame bracket profile comprising:

a bracket body arranged in a first plane, said bracket body having an upper end opposite a lower end, wherein a perimeter of the bracket body comprises:

a front edge, wherein the front edge of the bracket body is coupled to a first tooth feature and a second tooth feature arranged in the first plane, said first tooth feature proximate the bracket body upper end and said second tooth feature proximate the bracket body lower end, wherein the first tooth feature comprises a first tooth feature upper portion, a first tooth feature lower portion opposite the first tooth feature upper portion, and a first cavity, wherein the first cavity comprises:

a rise portion on the first tooth feature lower portion adjacent a bottom tip surface of the first tooth feature lower portion and parallel to the bracket body front edge;

a stop portion adjacent and perpendicular to the front edge of the bracket body; and an angled portion between the rise portion and the stop portion, said angled portion above said rise portion and diagonal to the bracket body front edge, wherein at least a portion of one or more of the rise portion, the angled portion, and the stop portion is configured to mate to a first opening of a first store frame and a second opening of a second store frame different from the first store frame;

a rear edge opposite the front edge;

a top edge comprising a platform support surface in a second plane perpendicular to the first plane; and a bottom edge.

17. The store frame bracket profile of claim 16, wherein a front edge of the first tooth feature lower portion comprises a first lead edge, a first curved profile, and a first tip surface, and further wherein the second tooth feature comprises a second tooth feature lower portion and a second cavity, wherein a front edge of the second tooth feature lower portion comprises a second lead edge, a second curved profile, and a second tip surface.

18. The store frame bracket profile of claim 17, wherein the second cavity comprises:

a rise portion adjacent a tip surface of the second tooth feature;

a stop portion adjacent the bracket body; and an angled portion between the rise portion and the stop portion, said angled portion above said rise portion, the angled portion of the second tooth feature is diagonal to the front edge of the bracket body, wherein at least a portion of one or more of the rise portion, the angled portion, and the stop portion is configured to mate to the first opening and a third opening of the first store frame and the second opening and a fourth opening of the second store frame different from the first store frame.

19. The store frame bracket profile of claim 18, wherein based on the perimeter of the bracket body, the store frame bracket profile is configured to removably couple to the first and third openings of the first store frame, and further wherein the store frame bracket profile is configured to removably couple to the second and fourth openings of the second store frame.

* * * * *